US011757225B2

(12) United States Patent
Nelson et al.

(10) Patent No.: US 11,757,225 B2
(45) Date of Patent: Sep. 12, 2023

(54) ELECTRICAL TERMINAL

(71) Applicant: DELPHI TECHNOLOGIES IP LIMITED, St. Michael (BB)

(72) Inventors: Charles S. Nelson, Fenton, MI (US); Gopinath Reddy Penamalli, Karnataka (IN); Kathryn M. McCauley, Durand, MI (US)

(73) Assignee: DELPHI TECHNOLOGIES IP LIMITED, St. Michael (BB)

( * ) Notice: Subject to any disclaimer, the term of this patent is extended or adjusted under 35 U.S.C. 154(b) by 219 days.

(21) Appl. No.: 17/198,496

(22) Filed: Mar. 11, 2021

(65) Prior Publication Data

US 2022/0294148 A1 Sep. 15, 2022

(51) Int. Cl.

| | |
|---|---|
| ***H01R 13/24*** | (2006.01) |
| ***H01R 13/432*** | (2006.01) |
| *H01R 13/533* | (2006.01) |

(52) U.S. Cl.

CPC ..... *H01R 13/432* (2013.01); *H01R 13/2435* (2013.01); *H01R 13/2442* (2013.01); *H01R 13/533* (2013.01); *H01R 2201/26* (2013.01)

(58) Field of Classification Search

None

See application file for complete search history.

(56) References Cited

U.S. PATENT DOCUMENTS

| | | | | |
|---|---|---|---|---|
| 9,407,047 | B1 * | 8/2016 | McCauley | H01R 13/193 |
| 10,761,048 | B2 * | 9/2020 | Oba | H01R 11/28 |
| 10,890,551 | B2 * | 1/2021 | Oba | G01N 33/0037 |
| 2014/0060926 | A1 | 3/2014 | Winkler et al. | |
| 2014/0298931 | A1 | 10/2014 | Oba et al. | |
| 2018/0011047 | A1 | 1/2018 | Oba et al. | |
| 2018/0011049 | A1 | 1/2018 | Oba et al. | |

* cited by examiner

*Primary Examiner* — Felix O Figueroa
(74) *Attorney, Agent, or Firm* — Joshua M. Haines

(57) ABSTRACT

A terminal includes a spine extending along a longitudinal axis from a first end to a second end and extending along a lateral axis, which is perpendicular to the longitudinal axis, from a first edge to a second edge. An attachment portion at the first end provides fixation to an electrical conductor. A contact portion extends from the second end and cantilevers over the spine such that the contact portion is spaced apart from the spine in a direction along a vertical axis which is perpendicular to both the longitudinal axis and the lateral axis. A locking tab extends from the first edge and has a locking tab attachment end which is fixed to first edge and which extends toward, and is aligned with, the contact portion in a direction parallel to the vertical axis. The locking tab also has a free end which flares outward beyond contact portion.

20 Claims, 8 Drawing Sheets

ELECTRICAL TERMINAL

TECHNICAL FIELD OF INVENTION

This disclosure relates to an electrical terminal which terminates an electrical conductor and more particularly to an electrical terminal used in exhaust sensors which are used to sense constituents of exhaust gases of internal combustion engines.

BACKGROUND OF INVENTION

The automotive industry has used exhaust sensors in automotive vehicles for many years to sense the constituents in exhaust gases which are communicated through an exhaust conduit of an internal combustion engine. By way of non-limiting example only, exhaust sensors have been used to sense concentrations of oxygen, NOx, ammonia, and particulate matter. It is common for such exhaust gas sensors to include a sensing element which has a ceramic substrate which supports various electrodes and electrical leads which, when exposed to the exhaust gases, are able to produce an electrical signal that can be used to determine the concentration of a target constituent in the exhaust gases. The ceramic substrate has one or more electrical contacts which mate with an electrical terminal of a wire which supplies power to, transmits a signal from, or provides a path for the sensing element.

Decreasing the size of the exhaust sensors has been an area of endeavor recently, however making the exhaust sensor smaller results in challenges. One challenge that results is making the electrical terminals compact enough while maintaining structural integrity and cost effectiveness. Furthermore, the electrical terminals are commonly housed in separate cavities of a connector body which is made of a ceramic material. One of two processes are typically used to form the connector body; dry pressing or injection molding. Dry pressing is preferred because injection molding is typically two to five times more expensive that dry pressing. However, dry pressing has limitations on the complexity of its geometry, especially when the material for the connector body is alumina which is higher in strength.

In the prior art, some electrical terminals are configured to be pulled into position, that is, the wire that is attached to the electrical terminal must fed through the connector body in order for the electrical terminal to be positioned within the connector body. However, such a configuration is susceptible to abrasion of the insulative coating of the wire when the wire passes through the connector body. In other examples, the electrical terminals are configured to be pushed into position, that is, the terminal is inserted into the connector body without the need for the wire to be fed through the connector body. However, such known arrangements typically require complex geometry for the cavity within which the electrical terminal is received and multiple electrical terminal designs are used in a single exhaust sensor, thereby requiring the management of multiple electrical terminals which increases cost and complexity.

What is needed is an electrical terminal for an exhaust sensor which minimizes or eliminates one or more of the shortcomings as set forth above.

SUMMARY OF THE INVENTION

Briefly described, an electrical terminal of unitary construction is configured to terminate an electrical conductor and provide electrical connection between the electrical conductor and a mating terminal and also being configured to be received along a longitudinal axis within a cavity of a connector body which is electrically insulative. The electrical terminal includes a central spine extending along the longitudinal axis from a first end to a second end and extending along a lateral axis, which is perpendicular to the longitudinal axis, from a first edge to a second edge; an attachment portion at the first end of the central spine which is configured to provide fixation to, and electrical communication with, the electrical conductor; a contact portion which extends from the second end of the central spine and cantilevers over the central spine such that the contact portion is spaced apart from the central spine in a direction along a vertical axis which is perpendicular to both the longitudinal axis and the lateral axis, wherein the contact portion is configured to mate with the mating terminal within the connector body; and a locking tab which extends from one of the first edge and the second edge, the locking tab having a locking tab attachment end which is fixed to the one of the first edge and the second edge and which extends toward, and is aligned with, the contact portion in a direction parallel to the vertical axis, the locking tab also having a free end which flares outward beyond contact portion, the locking tab being resilient and compliant, thereby allowing the locking tab to flex along the lateral axis as the electrical terminal is being inserted into the cavity along the longitudinal axis in a first direction and to rebound when the electrical terminal is fully inserted into the cavity, thereby preventing the electrical terminal from being removed from the cavity along the longitudinal axis in a second direction which is opposed to the first direction.

An electrical connector assembly includes a connector body which is electrically insulative, said connector body having a cavity which extends along a longitudinal axis; a mating terminal within said connector body; and an electrical terminal of unitary construction which terminates an electrical conductor and provides electrical communication between said electrical conductor and said mating terminal, said electrical terminal being received within said cavity along said longitudinal axis. The electrical terminal includes a central spine extending along said longitudinal axis from a first end to a second end and extending along a lateral axis, which is perpendicular to said longitudinal axis, from a first edge to a second edge; an attachment portion at said first end of said central spine which is configured to provide fixation to, and electrical communication with, said electrical conductor; a contact portion which extends from said second end of said central spine and cantilevers over said central spine such that said contact portion is spaced apart from said central spine in a direction along a vertical axis which is perpendicular to both said longitudinal axis and said lateral axis, wherein said contact portion mates with said mating terminal within said connector body; and a locking tab which extends from one of said first edge and said second edge, said locking tab having a locking tab attachment end which is fixed to said one of said first edge and said second edge and which extends toward, and is aligned with, said contact portion in a direction parallel to said vertical axis, said locking tab also having a free end which flares outward beyond said contact portion, said locking tab being resilient and compliant, thereby allowing said locking tab to flex along said lateral axis as said electrical terminal is being inserted into said cavity along said longitudinal axis in a first direction and to rebound when said electrical terminal is fully inserted into said cavity, thereby preventing said electrical terminal from being removed from said cavity along said longitudinal axis in a second direction which is opposed to said first direction.

The electrical terminal and electrical connector assembly as described herein provides compact construction while providing enhanced resistance to pull-out from the connector body and also the ability to use a single design of electrical terminal for exhaust sensors which require multiple electrical terminals.

BRIEF DESCRIPTION OF DRAWINGS

The present invention will now be described, by way of example with reference to the accompanying drawings, in which.

DETAILED DESCRIPTION OF INVENTION

Figure 1:
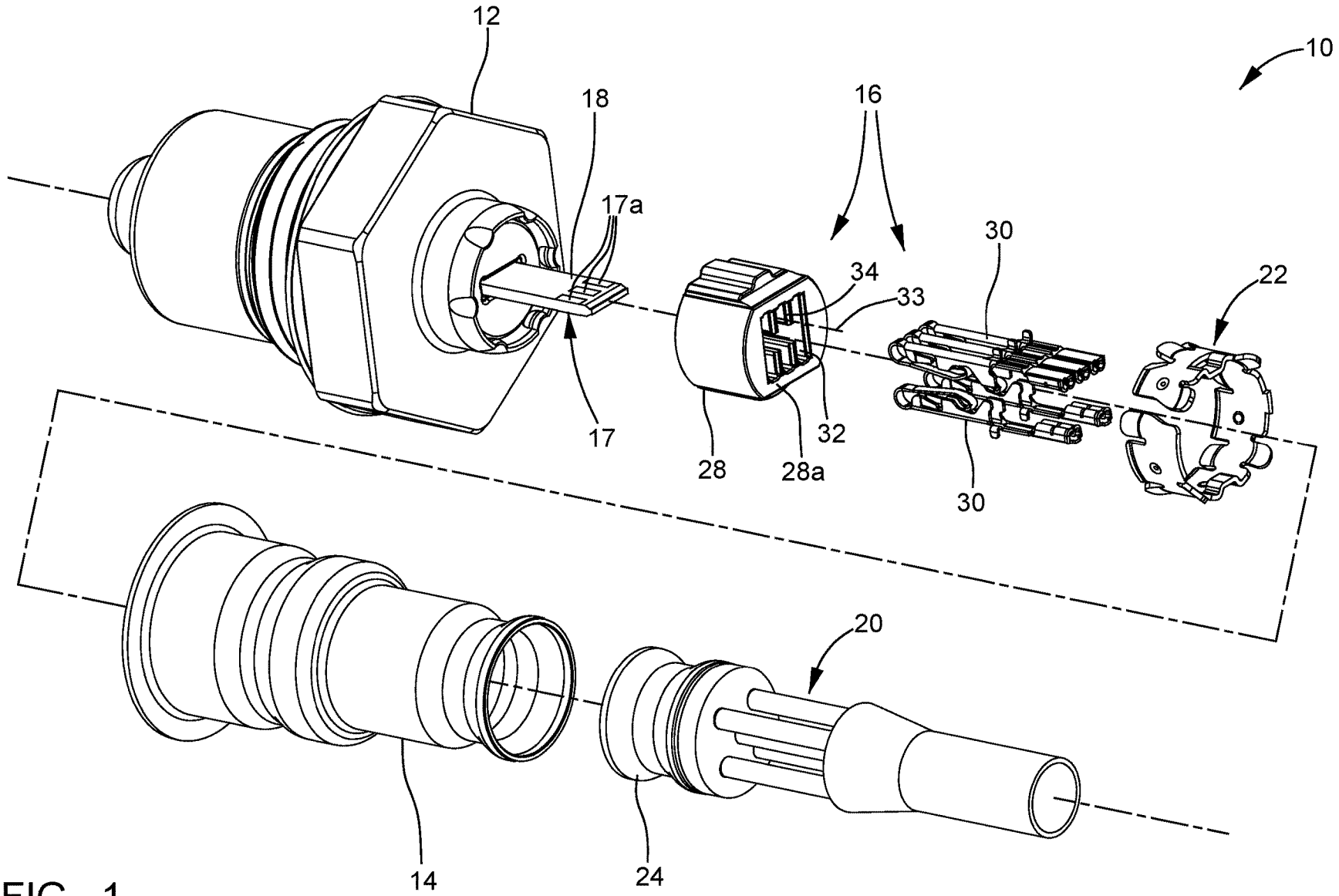
FIG. 1 is a partially exploded isometric view of an exhaust sensor of the present disclosure.

With initial reference to FIG. 1, an exhaust sensor 10 in accordance with the present disclosure is provided for sensing constituents of exhaust gases, for example exhaust gases produced by an internal combustion engine (not shown). The exhaust sensor 10 includes a front housing 12; a rear housing 14; an electrical connector assembly 16 configured to interconnect a sensing element 17 (shown already assembled to front housing 12) having sensing element substrate 18, which contains the exhaust sensor circuitry (not shown), to a plurality of wire cables 20; a clip 22 configured to secure the electrical connector assembly 16 within rear housing 14, and a protective seal 24 to protect the wire cables 20.

With continued reference to FIG. 1, and now with additional reference to FIGS. 2-8, the details of electrical connector assembly 16, hereinafter referred to as the connector 16, will be provided. Connector 16 is made up of an electrically insulative connector body 28 and at least one electrical terminal 30 that, when fully assembled, is at least partially disposed within a cavity 32 defined by the connector body 28. Five electrical terminals 30 and six cavities 32 have been illustrated herein with only representative electrical terminals 30 and cavities 32 being labeled with the understanding that the descriptions provided herein are equally applicable to each electrical terminal 30 and each cavity 32. Cavity 32 is defined along a longitudinal axis 33 and extends from an opening in a front surface of the connector body 28 through to another opening in a rear surface (not shown due to perspective) of the connector body 28. According to the illustrated embodiment, the connector body 28 has six cavities 32 with a generally square cross section. Other embodiments having more or fewer cavities with generally square, rectangular, or other cross-sectional shapes may also be envisioned.

Figure 3:
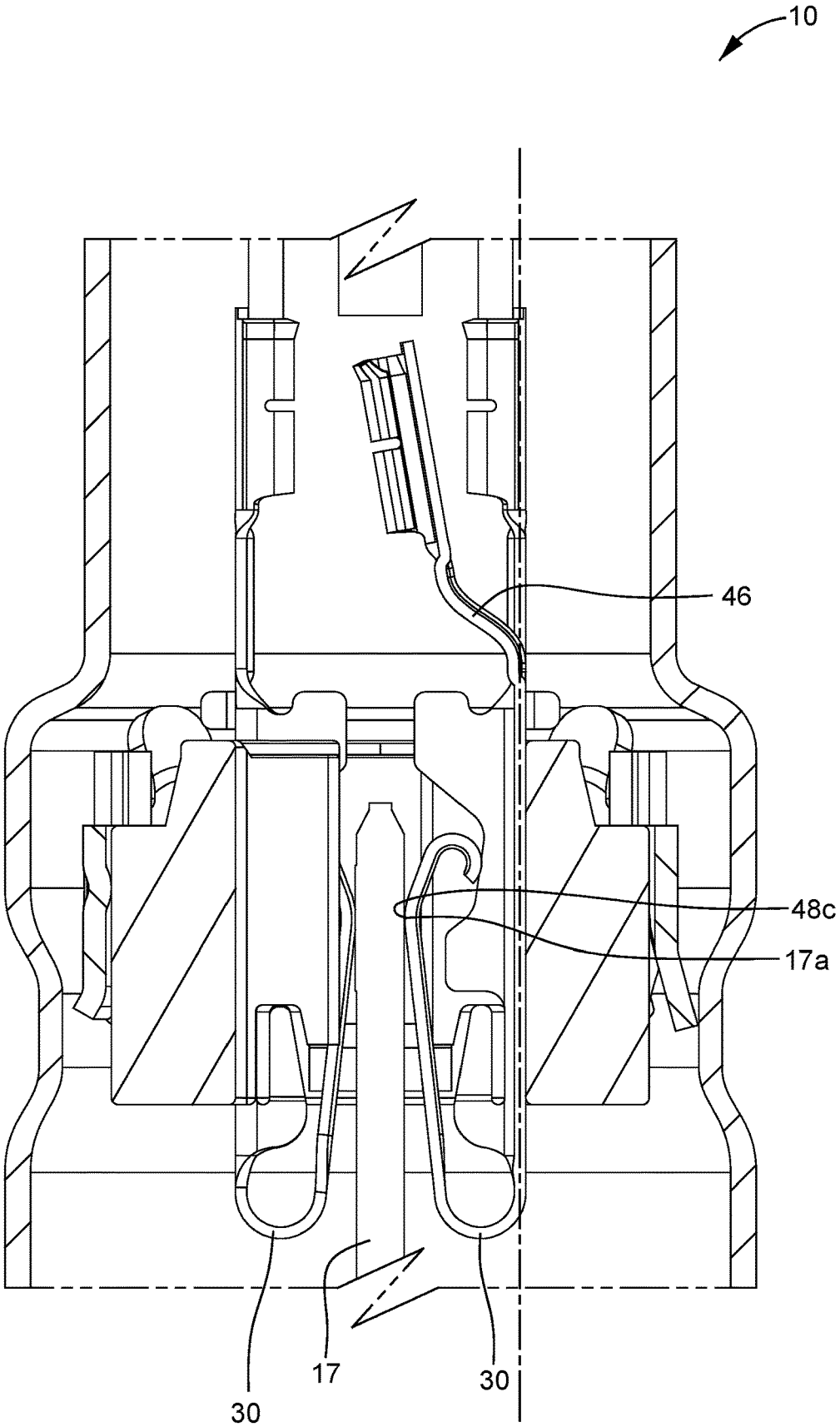

The connector body 28 is formed of a dielectric material, such as a polymeric or ceramic material. The choice of material will be primarily dependent on the intended application of the connector 16, however, in the case of exhaust sensor 10, the material is a ceramic material due to the temperatures to which exhaust sensor 10 will be exposed. The connector body 28 may be formed by molding the material into the desired shape, for example through dry pressing or injection molding which are both known to those of ordinary skill in the art. As can be seen in FIG. 1, each cavity 32 is a subset of a central opening of connector body 28 such that cavities 32 are formed by the periphery of the central opening and walls 34 extending inward from the periphery of the central opening. As can be seen in FIG. 3, sensing element 17 is positioned between opposing electrical terminals 30 such that electrical terminals 30 are held in compression and apply a normal force to sensing element 17. The design and fabrication of connector bodies of this type are well known to those skilled in the art.

Electrical terminals 30 will be described in greater detail in the paragraphs that follow, however, it should be noted that all electrical terminals 30 are substantially identical unless noted otherwise, and consequently, the description will refer to a single electrical terminal 30 with the understanding that the description is equally applicable to all electrical terminals 30 of exhaust sensor 10. Electrical terminal 30 is made of an electrically conductive material and is unitary in construction, i.e. a single continuous piece of material. Due to the high temperatures electrical terminal 30 will see in the operation of exhaust sensor 10, electrical terminal 30 is made of stainless steel which is resistive to oxidation at high temperatures, however, if electrical terminal 30 is used in an application which will experience lower temperatures, copper-based materials or other materials commonly used for electrical terminals may alternatively be used. Each electrical terminal 30 terminates an electrical conductor, more specifically one of wire cables 20, and provides electrical communication between wire cable 20 and a mating terminal 17*a* of sensing element 17 for connection to the exhaust sensor circuitry. It should be noted that wire cables 20 are not illustrated as being fixed to their respective electrical terminals 30 in FIG. 1 even though electrical terminals 30 are illustrated as being crimped to fix electrical terminals 30 to wire cables 20, however, this was done to provide clarity in the figure. Each electrical terminal 30 is received within a respective one of cavities 32 along longitudinal axis 33, i.e. electrical terminal 30 is inserted into cavity 32 in a direction parallel to longitudinal axis 33.

Electrical terminal 30 includes a central spine 36 which extends along longitudinal axis 33 from a first end 36*a* to a second end 36*b*. Central spine 36 also extends along a lateral axis 38, which is perpendicular to longitudinal axis 33, from a first edge 36*c* to a second edge 36*d*. As will be described in the following paragraphs, central spine 36 serves as a foundation from which other features extend.

Figure 2:
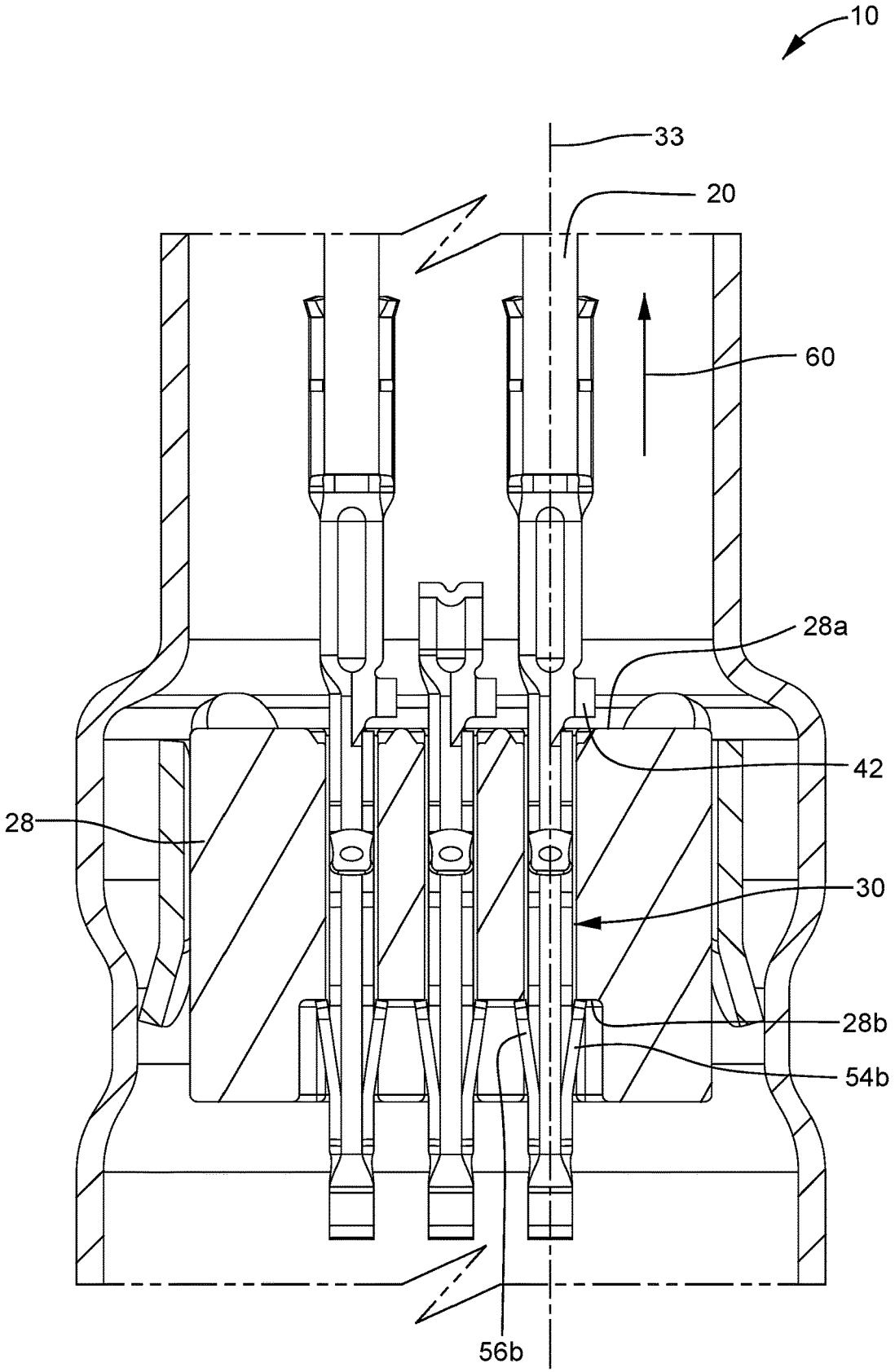
FIGS. 2 and 3 are cross-sectional views showing an electrical connector assembly of the exhaust sensor.

An attachment portion 40 is provided at first end 36*a* of central spine 36. Attachment portion 40 is configured to provide fixation to, and electrical communication with, a respective one of wire cables 20. As illustrated in the figures, attachment portion 40 includes opposing crimp wings 40*a*, 40*b* which extend from first edge 36*c* and second edge 36*d* respectively. Crimp wings 40*a*, 40*b* are crimped, i.e. folded and compressed, around wire cable 20. Other embodiments of attachment portion 40 may be envisioned, for example in which the attachment portion 40 comprises a tubular section that is crimped or soldered to wire cable 20 or a planar section to which wire cable 20 is sonically welded. Other attachment means known to those skilled in the art may also be used for attachment portion 40. It should be noted that only FIGS. 2 and 3 illustrate wire cables 20 fixed to respective electrical terminals 30 in order to provide clarity to electrical terminals 30. Furthermore, FIGS. 1 and 4-7 show electrical terminals 30 in a crimped state even though wire cables 20 have been omitted for clarity.

A stop wing 42 extends from central spine 36 at a location between first end 36*a* and second end 36*b* such that stop wing 42 limits the extent to which electrical terminal 30 is inserted into cavity 32. As illustrated in the figures, stop wing 42 extends from first edge 36*c*, however, may alternatively extend from second edge 36*d*. Stop wing 42 is bent to extend in a direction along, i.e. parallel to, a vertical axis 44 which is perpendicular to both longitudinal axis 33 and lateral axis 38. As a result, when electrical terminal 30 is inserted into cavity 32, stop wing 42 is aligned with a first face 28*a* of connector body 28 in a direction parallel to longitudinal axis 33 as is most clearly visible in FIG. 2, thereby preventing electrical terminal 30 from being inserted beyond an interface of stop wing 42 and first face 28*a*.

A neck 46 of central spine 36 is located between attachment portion 40 and first sidewall 50/second sidewall 52 such that neck 46 is flexible which allows for deformation of neck 46 after electrical terminal 30 is positioned within cavity 32. This flexibility of neck 46 allows for use of the same design of electrical terminal 30 in each cavity 32 while allowing subsequent deformation to ensure electrical separation between neck 46 and attachment portion 40 of all electrical terminals 30 that are provided in electrical connector assembly 16. As used herein, neck 46 being flexible is defined by neck 46 having a minimum length according to the formula:

$$\text{minimum neck length} = \text{height of attachment portion} + 2(\text{neck material thickness} * 1.5);$$

where the minimum neck length is a measure of neck 46 in a direction parallel to longitudinal axis 33, the height of attachment portion is a measure of attachment portion 40 in a direction parallel to vertical axis 44 after being crimped to wire cable 20, and the neck material thickness is a measure, in a direction parallel to vertical axis 44, of the material which forms neck 46. When electrical terminals 30 are initially installed within connector body 28, each electrical terminal 30 is shaped the same as illustrated in FIG. 1. However, after electrical terminals 30 are installed within connector body 28, one or more necks 46 may be deformed to ensure adequate electrical separation of electrical terminals 30 at attachment portion 40. An example of one neck 46 being deformed is illustrated in FIG. 3.

Electrical terminal 30 also includes a contact portion 48 which extends from second end 36*b* of central spine 36 and cantilevers over central spine 36 such that contact portion 48 is spaced apart from central spine 36 in a direction parallel to vertical axis 44. Contact portion 48 extends from a bend 48*a*, which is attached to central spine 36, to a contact free end 48*b* which is fixed to central spine 36 only through bend 48*a*. In this way, contact portion 48 is resilient and compliant such that that contact portion 48 is elastically deformed when sensing element 17 is inserted into connector body 28 between opposing electrical terminals 30. Between bend 48*a* and contact free end 48*b*, contact portion 48 includes an apex 48*c* which mates with mating terminal 17*a* and which results from a change in polarity of slope of contact portion 48, i.e. a change from positive slope between bend 48*a* and apex 48*c* to a negative slope between apex 48*c* and contact free end 48*b*. Additionally, as is most clearly shown in FIG. 8, contact portion 48 is crowned across lateral axis 38, i.e. in a direction parallel to lateral axis 38 such that contact portion 48 is a convex curve facing away from central spine 36. Furthermore, contact portion 48 is dished across lateral axis 38 such that contact portion 48 is a concave curve facing toward central spine 36. The crowned nature of contact portion 48 ensures good electrical contact with mating terminal 17*a* even if electrical terminal 30 is rotated in cavity 32.

Figure 4:
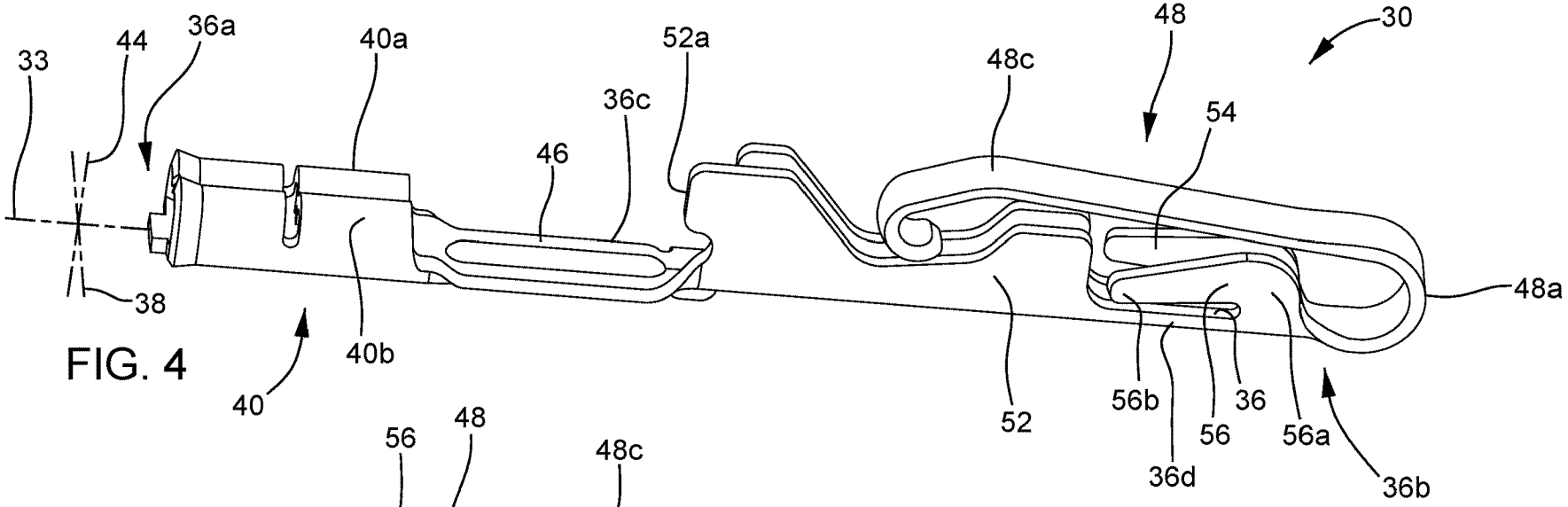
FIGS. 4 and 5 are isometric views of an electrical terminal of the electrical connector assembly taken from different perspectives.
Figure 5:
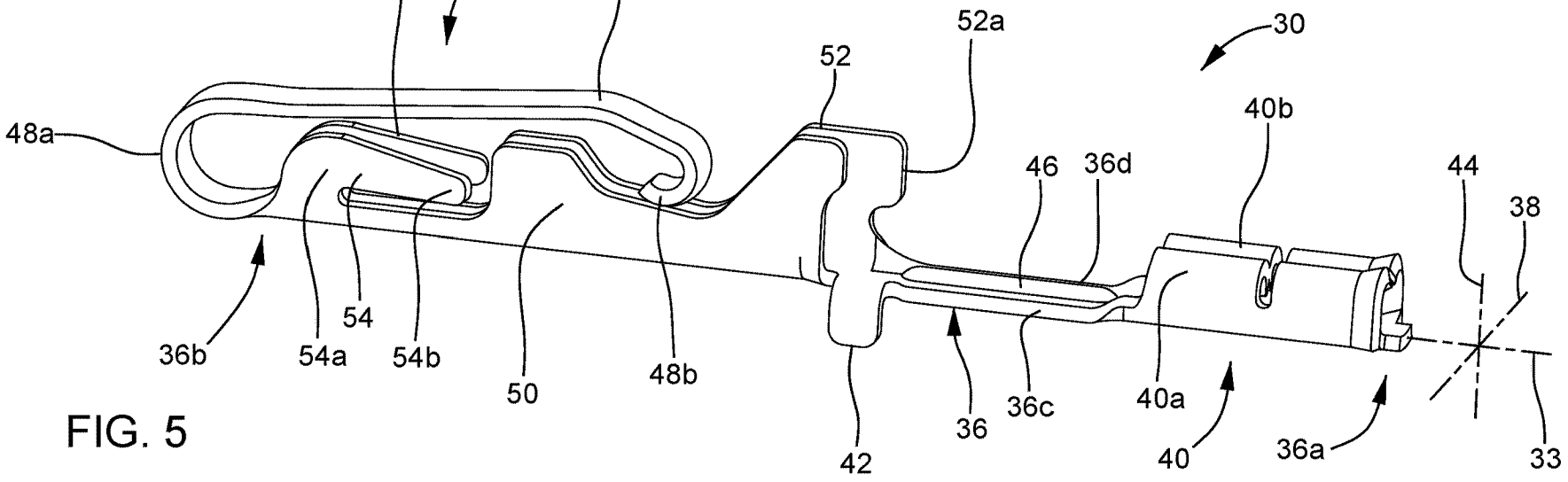
Figure 6:
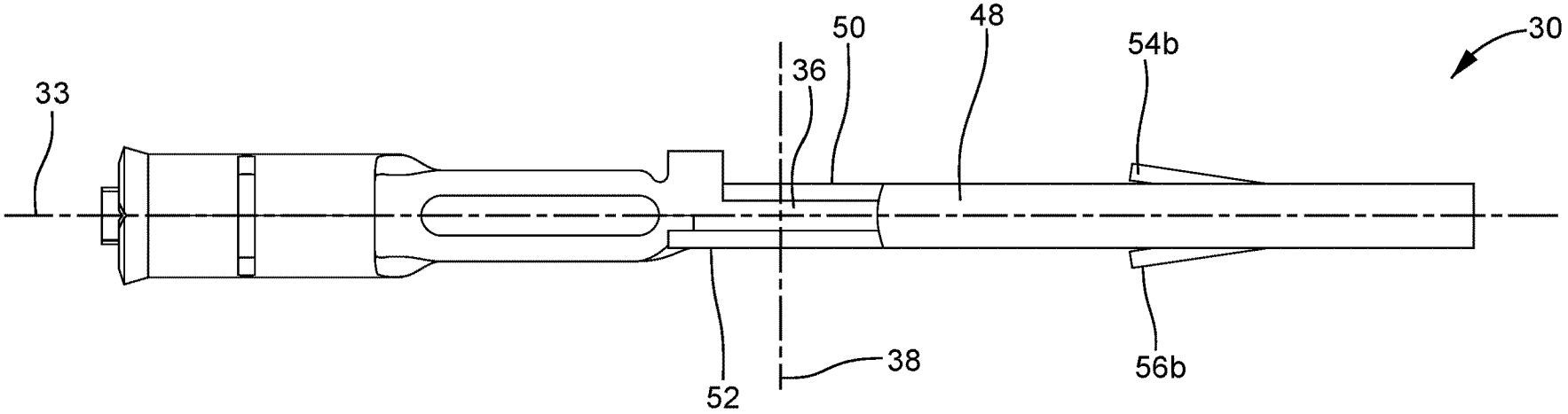
FIGS. 6 and 7 are elevation views of the electrical terminal taken from different perspectives.
Figure 7:
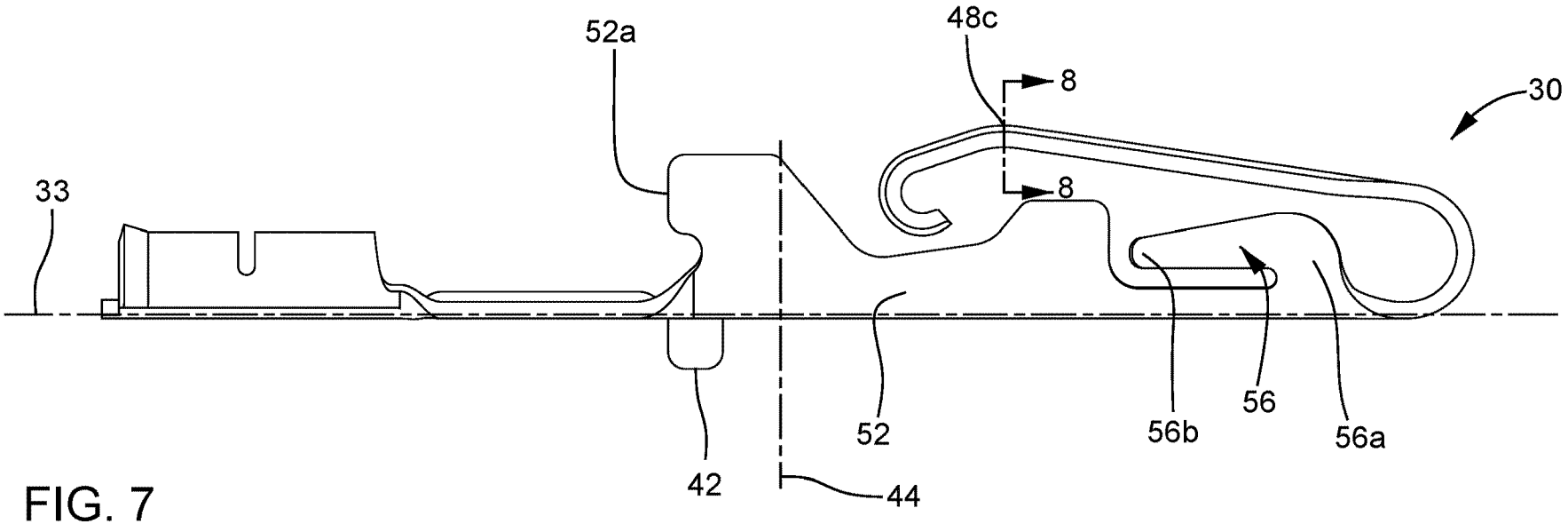
Figure 8:
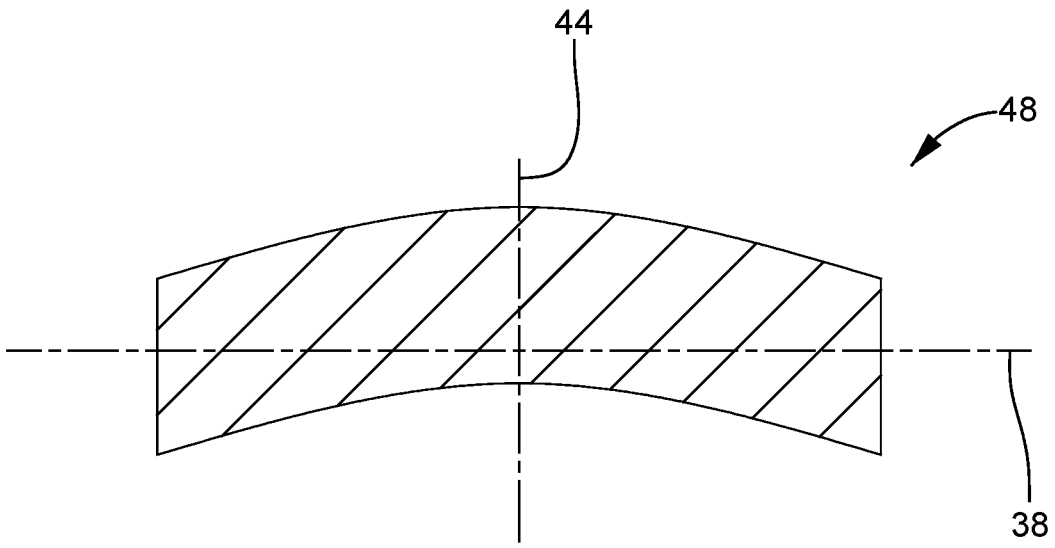
FIG. 8 is a cross-sectional view of a contact portion of the electrical terminal taken through section line 8-8 of FIG. 7.

Electrical terminal 30 also includes a first sidewall 50 extending from first edge 36*c* and a second sidewall 52 extending from second edge 36*d*. First sidewall 50 and second sidewall 52 both extend in a direction parallel to vertical axis 44 such that first sidewall 50 and second sidewall 52 are spaced apart from each other along lateral axis 38. In this way, central spine 36, first sidewall 50, and second sidewall 52 provide a U-shaped cross-sectional shape which adds strength and rigidity to electrical terminal 30. First sidewall 50 and second sidewall 52 each extend along vertical axis 44 to a greater extent than attachment portion 40 which is most clearly visible in FIG. 7, thereby allowing at least one of first sidewall 50 and second sidewall 52 to have a push surface, illustrated in the figures as push surface 52*a*, which provides a surface for tooling (not shown) to push against to push electrical terminal 30 into cavity 32 during assembly. FIGS. 4 and 5 have been drawn to show contact portion 48 in a compressed state as in FIG. 3, and as can be seen, contact free end 48*b* of contact portion 48 engages first sidewall 50 and second sidewall 52 when compressed by sensing element 17.

Figure 9:
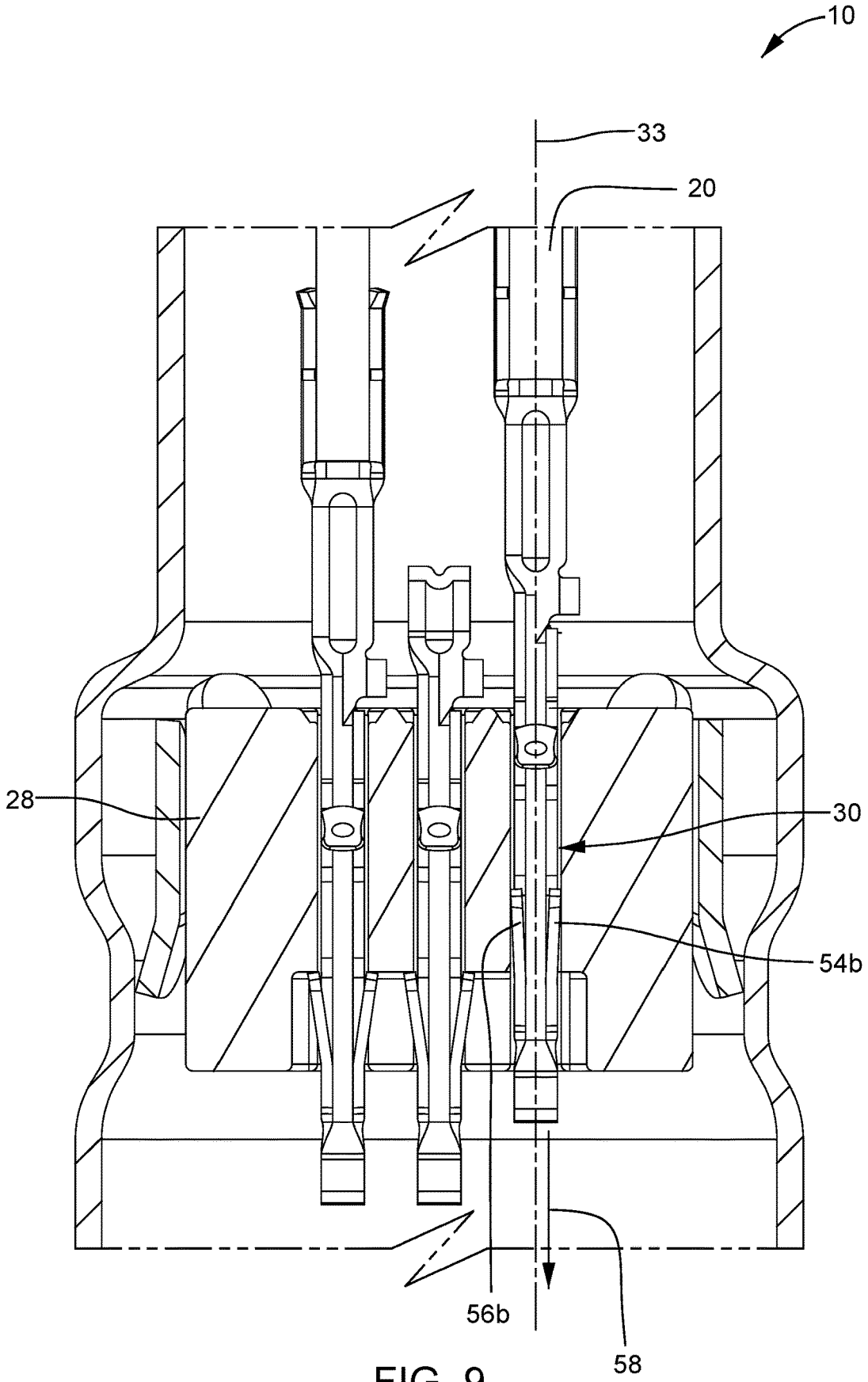
FIG. 9 is the cross-sectional view of FIG. 2, now shown with one electrical terminal being inserted into a connector body.

Electrical terminal 30 also includes a first locking tab 54 extending from first edge 36*c* at a location between first sidewall 50 and second end 36*b* and a second locking tab 56 extending from second edge 36*d* at a location between second sidewall 52 and second end 36*b*. First locking tab 54 includes a first locking tab attachment end 54*a* which is fixed to first edge 36*c* and which is distal from first sidewall 50 and also includes a first locking tab free end 54*b* which is fixed to central spine 36 only through first locking tab attachment end 54*a*. First locking tab attachment end 54*a* extends toward, and is aligned with, contact portion 48 in a direction parallel to vertical axis 44. First locking tab free end 54*b* flares outward beyond first sidewall 50 and beyond contact portion 48. Similarly, second locking tab 56 includes a second locking tab attachment end 56*a* which is fixed to second edge 36*d* and which is distal from second sidewall 52 and also includes a second locking tab free end 56*b* which is fixed to central spine 36 only through second locking tab attachment end 56*a*. Second locking tab attachment end 56*a* extends toward, and is aligned with, contact portion 48 in a direction parallel to vertical axis 44. Second locking tab free end 56*b* flares outward beyond first edge 36*c*. First locking tab 54 and second locking tab 56 are both resilient and compliant and cumulatively flare outward such that they are cumulatively wider than the cavity 32, and consequently, when electrical terminal 30 is being inserted into cavity 32 along longitudinal axis 33 in a first direction 58 (shown in FIG. 9), first locking tab 54 and second locking tab 56 flex inward along lateral axis 38 (also shown in FIG. 9) and rebound to their pre-flexed shape when electrical terminal 30 is fully inserted into cavity 32 (shown in FIG. 2). When electrical terminal 30 is fully inserted into cavity 32, first locking tab 54 and second locking tab 56 are located outward of cavity 32 such that first locking tab free end 54*b* and second locking tab free end 56*b* are aligned with a second face 28*b* of connector body 28 in a direction parallel to longitudinal axis 33 such that second face 28*b* is opposed to first face 28*a*. Consequently, first locking tab 54 and second locking tab 56 prevent electrical terminal 30 from being removed from cavity 32 along longitudinal axis 33 in a second direction 60 (shown in FIG. 2) which is opposed to first direction 58. As can be seen particularly in FIG. 6, first locking tab free end 54*b* and second locking tab free end 56*b* cumulatively represent the widest portion of electrical terminal 30 from first sidewall 50 and second sidewall 52 to second end 36*b* in a direction parallel to lateral axis 38. While electrical terminal 30 has been described herein as including both first locking tab 54 and second locking tab 56, it should be understood that one of first locking tab 54 and second locking tab 56 may be omitted, however, retention capabilities, i.e. resistance to electrical terminal 30 from being pulled out of connector body 28 in second direction 60, may be reduced.

Figure 10:
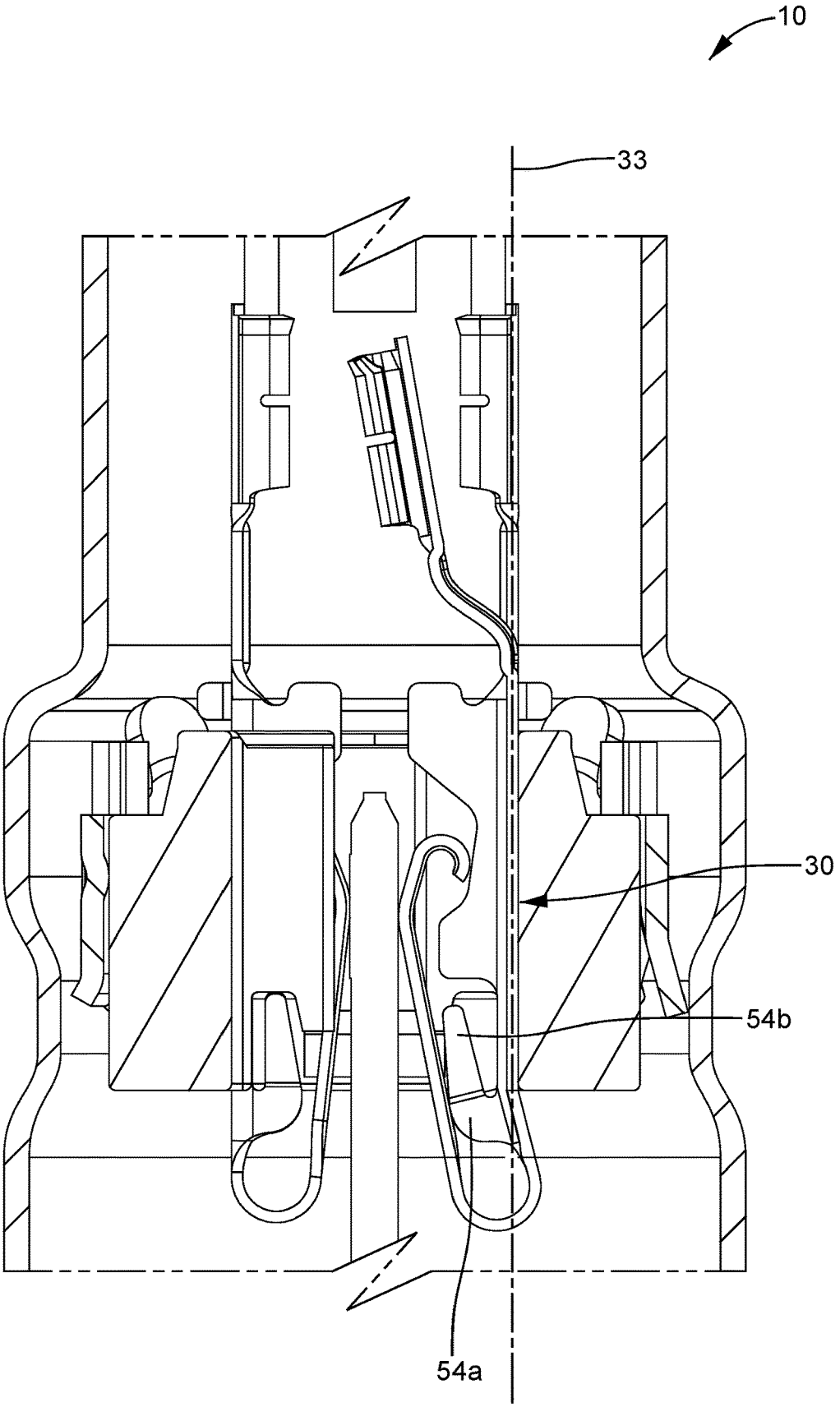
FIG. 10 is the cross-sectional view of FIG. 3, now shown with one electrical terminal being deformed.

It is important to note that when electrical terminal 30 is fully inserted, central spine 36 is unsupported by connector body 28 from first locking tab attachment end 54*a* and second locking tab attachment end 56*a* to second end 36*b* which is most easily visible in FIG. 3. As a result, if a force is applied to wire cable 20 in second direction 60 which would attempt to pull electrical terminal 30 out of connector body 28 with sufficient force, electrical terminal 30 may be deformed as shown in FIG. 10. However, due to first locking tab attachment end 54*a* and second locking tab attachment end 56*a* being aligned with contact portion 48 in a direction parallel to vertical axis 44, contact portion 48 will engage first locking tab attachment end 54*a* and second locking tab attachment end 56*a*, thereby stiffening electrical terminal 30. This stiffening of electrical terminal 30 will minimize deformation of electrical terminal 30, thereby minimizing the likelihood of the connection with mating terminal 17*a* being compromised. Without first locking tab attachment end 54*a* and second locking tab attachment end 56*a* limiting deformation of electrical terminal 30, connection with mating terminal 17*a* may otherwise be compromised and the force required to pull electrical terminal 30 out of connector body 28 would be decreased.

Electrical terminal 30 as described herein provides compact construction while providing enhanced resistance to electrical terminal 30 being pulled out from connector body 28. Electrical terminal 30 also allows for a single design to be used for all terminals in exhaust sensor 10.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical terminal of unitary construction configured to terminate an electrical conductor and provide electrical connection between said electrical conductor and a mating terminal and also being configured to be received along a longitudinal axis within a cavity of a connector body which is electrically insulative, said electrical terminal comprising:

a central spine extending along said longitudinal axis from a first end to a second end and extending along a lateral axis, which is perpendicular to said longitudinal axis, from a first edge to a second edge;

an attachment portion at said first end of said central spine which is configured to provide fixation to, and electrical communication with, said electrical conductor;

a contact portion which extends from said second end of said central spine and cantilevers over said central spine such that said contact portion is spaced apart from said central spine in a direction along a vertical axis which is perpendicular to both said longitudinal axis and said lateral axis, wherein said contact portion is configured to mate with said mating terminal within said connector body; and a locking tab which extends from one of said first edge and said second edge, said locking tab having a locking tab attachment end which is fixed to said one of said first edge and said second edge and which extends toward, and is aligned with, said contact portion in a direction parallel to said vertical axis, said locking tab also having a free end which flares outward beyond said contact portion, said locking tab being resilient and compliant, thereby allowing said locking tab to flex along said lateral axis as said electrical terminal is being inserted into said cavity along said longitudinal axis in a first direction and to rebound when said electrical terminal is fully inserted into said cavity, thereby preventing said electrical terminal from being removed from said cavity along said longitudinal axis in a second direction which is opposed to said first direction.

2. An electrical terminal as in claim 1, said electrical terminal further comprising:

a first sidewall extending from said first edge and parallel to said vertical axis such that said first sidewall is located between said attachment portion and said free end of said locking tab;

a second sidewall extending from said second edge and parallel to said vertical axis such that said first sidewall and said second sidewall are spaced apart from each other along said lateral axis.

3. An electrical terminal as in claim 2, wherein said first sidewall and said second sidewall extend away from said central spine in a direction parallel to said vertical axis to a greater extent than said attachment portion, thereby allowing one of said first sidewall and said second sidewall to be used for pushing said electrical terminal into said cavity.

4. An electrical terminal as in claim 2, wherein said locking tab attachment end is proximal to said second end and said free end of said locking tab is distal from said second end.

5. An electrical terminal as in claim 2, wherein:

said contact portion includes a bend which is attached to said central spine such that said contact portion extends from said bend to a contact free end which is fixed to said central spine only through said bend;

said contact free end is aligned with said first sidewall in a direction parallel to said vertical axis; and said contact free end is aligned with said second sidewall in a direction parallel to said vertical axis.

6. An electrical terminal as in claim 2, wherein a neck of said central spine extends from said attachment portion to said first sidewall and to said second sidewall such that said neck has a minimum length according to the formula:

$$\text{minimum neck length} = \text{height of attachment portion} + 2(\text{neck material thickness} * 1.5);$$

where said minimum neck length is a measure of said neck in a direction parallel to said longitudinal axis, said height of attachment portion is a measure of said attachment portion in a direction parallel to said vertical axis, and said neck material thickness is a measure, in a direction parallel to said vertical axis, of material which forms said neck.

7. An electrical terminal as in claim 1, wherein said contact portion is crowned across said lateral axis such that said contact portion is a convex curve facing away from said central spine.

8. An electrical terminal as in claim 7, wherein said contact portion is dished across said lateral axis such that said contact portion is a concave curve facing toward said central spine.

9. An electrical terminal as in claim 1, wherein:

said locking tab is a first locking tab which extends from said first edge said locking tab attachment end is a first locking tab attachment end which is fixed to said first edge;

said free end is a first locking tab free end; and said electrical terminal also includes:

a second locking tab which extends from said second edge, said second locking tab having a second locking tab attachment end which is fixed to said second edge and which extends toward, and is aligned with, said contact portion in a direction parallel to said vertical axis, said second locking tab also having a second locking tab free end which flares outward beyond said contact portion, said locking tab being resilient and compliant, thereby allowing said second locking tab to flex along said lateral axis as said electrical terminal is being inserted into said cavity along said longitudinal axis in said first direction and to rebound when said electrical terminal is fully inserted into said cavity, thereby preventing said electrical terminal from being removed from said cavity along said longitudinal axis in said second direction.

10. An electrical terminal as in claim 9, wherein:

said first locking tab attachment end is proximal to said second end and said first locking tab free end is distal from said second end; and said second locking tab attachment end is proximal to said second end and said second locking tab free end is distal from said second end.

11. An electrical connector assembly comprising:

a connector body which is electrically insulative, said connector body having a cavity which extends along a longitudinal axis;

a mating terminal within said connector body; and an electrical terminal of unitary construction which terminates an electrical conductor and provides electrical communication between said electrical conductor and said mating terminal, said electrical terminal being received within said cavity along said longitudinal axis, said electrical terminal comprising:

a central spine extending along said longitudinal axis from a first end to a second end and extending along a lateral axis, which is perpendicular to said longitudinal axis, from a first edge to a second edge;

an attachment portion at said first end of said central spine which is configured to provide fixation to, and electrical communication with, said electrical conductor;

a contact portion which extends from said second end of said central spine and cantilevers over said central spine such that said contact portion is spaced apart from said central spine in a direction along a vertical axis which is perpendicular to both said longitudinal axis and said lateral axis, wherein said contact portion mates with said mating terminal within said connector body; and a locking tab which extends from one of said first edge and said second edge, said locking tab having a locking tab attachment end which is fixed to said one of said first edge and said second edge and which extends toward, and is aligned with, said contact portion in a direction parallel to said vertical axis, said locking tab also having a free end which flares outward beyond said contact portion, said locking tab being resilient and compliant, thereby allowing said locking tab to flex along said lateral axis as said electrical terminal is being inserted into said cavity along said longitudinal axis in a first direction and to rebound when said electrical terminal is fully inserted into said cavity, thereby preventing said electrical terminal from being removed from said cavity along said longitudinal axis in a second direction which is opposed to said first direction.

12. An electrical connector assembly as in claim 11, wherein said central spine is unsupported by said connector body from said locking tab attachment end to said second end.

13. An electrical connector assembly as in claim 11, wherein said electrical terminal further comprises:

a first sidewall extending from said first edge and parallel to said vertical axis such that said first sidewall is located between said attachment portion and said free end of said locking tab;

a second sidewall extending from said second edge and parallel to said vertical axis such that said first sidewall and said second sidewall are spaced apart from each other along said lateral axis.

14. An electrical connector assembly as in claim 13, wherein said first sidewall and said second sidewall extend away from said central spine in a direction parallel to said vertical axis to a greater extent than said attachment portion, thereby allowing one of said first sidewall and said second sidewall to be used for pushing said electrical terminal into said cavity.

15. An electrical connector assembly as in claim 13, wherein said locking tab attachment end is proximal to said second end and said free end of said locking tab is distal from said second end.

16. An electrical connector assembly as in claim 13, wherein:

said contact portion includes a bend which is attached to said central spine such that said contact portion extends from said bend to a contact free end which is fixed to said central spine only through said bend;

said contact free end is aligned with said first sidewall in a direction parallel to said vertical axis such that said contact free end engages said first sidewall; and said contact free end is aligned with said second sidewall in a direction parallel to said vertical axis such that said contact free end engages said second sidewall.

17. An electrical connector assembly as in claim 13, wherein a neck of said central spine extends from said attachment portion to said first sidewall and to said second sidewall such that said neck has a minimum length according to the formula:

$$\text{minimum neck length} = \text{height of attachment portion} + 2(\text{neck material thickness} * 1.5);$$

where said minimum neck length is a measure of said neck in a direction parallel to said longitudinal axis, said height of attachment portion is a measure of said attachment portion in a direction parallel to said vertical axis, and said neck material thickness is a measure, in a direction parallel to said vertical axis, of material which forms said neck.

18. An electrical connector assembly as in claim 11, wherein said contact portion is crowned across said lateral axis such that said contact portion is a convex curve facing away from said central spine.

19. An electrical connector assembly as in claim 18, wherein said contact portion is dished across said lateral axis such that said contact portion is a concave curve facing toward said central spine.

20. An electrical connector assembly as in claim 11, wherein:

said locking tab is a first locking tab which extends from said first edge said locking tab attachment end is a first locking tab attachment end which is fixed to said first edge;

said free end is a first locking tab free end; and said electrical terminal also includes:

a second locking tab which extends from said second edge, said second locking tab having a second locking tab attachment end which is fixed to said second edge and which extends toward, and is aligned with, said contact portion in a direction parallel to said vertical axis, said second locking tab also having a second locking tab free end which flares outward beyond said contact portion, said locking tab being resilient and compliant, thereby allowing said second locking tab to flex along said lateral axis as said electrical terminal is being inserted into said cavity along said longitudinal axis in said first direction and to rebound when said electrical terminal is fully inserted into said cavity, thereby preventing said electrical terminal from being removed from said cavity along said longitudinal axis in said second direction.

* * * * *